US005488922A

United States Patent [19]

Hinderberger

[11] Patent Number: 5,488,922

[45] Date of Patent: Feb. 6, 1996

[54] COLLAPSIBLE BOAT

[75] Inventor: Friedel Hinderberger, Schongau, Germany

[73] Assignee: Robert J. Compton, Fort Pierce, Fla.

[21] Appl. No.: 231,470

[22] Filed: Apr. 22, 1994

[30] Foreign Application Priority Data

Apr. 25, 1993 [DE] Germany ..... 43 13 600.1
Feb. 25, 1994 [DE] Germany ..... 44 06 283.4

[51] Int. Cl.[6] ..... B63B 7/00
[52] U.S. Cl. ..... 114/354
[58] Field of Search ..... 114/352, 353, 114/354, 355, 359

[56] References Cited

U.S. PATENT DOCUMENTS 2,193,892 3/1940 Van Gorden ..... 114/358
3,108,295 10/1963 Schor et al. ..... 114/354
3,264,020 8/1966 Ridder ..... 114/355

*Primary Examiner*—Jesus D. Sotelo
*Attorney, Agent, or Firm*—Carroll F. Palmer

[57] ABSTRACT

A collapsible boat having a contoured hull shape is disclosed in which the individual component surfaces of the hull may be folded both longitudinally and transversely via disengageable clamping mechanisms that maintain the boat water-tight when it is fully assembled. The lateral edges of the individual hull components, made preferably of aluminum, are profiled so they may be pivoted around a common axis into a relative position where they press together against one another to form a water-tight, longitudinally stable hull.

16 Claims, 8 Drawing Sheets

COLLAPSIBLE BOAT

BACKGROUND OF THE INVENTION

The invention relates to a boat that may be collapsed, having a boat body consisting of a myriad of hull surfaces, and with at least two hull surfaces, the lateral edges of which, in dismantled state, lie loose opposite each other.

Folding boats of the type indicated consist, usually, of individual boat wall components, which are joined to one another by means of watertight separating joints, in such a manner as to be firm and indissoluble.

Thus, for example, the publications US-PS U.S. Pat. No. 3,184,768, French patent 22 88 026, and U.S. Pat. No. 2,271,338 teach of folding boats that have rigid boat wall components, which are linked to one another, in each case, by means of water-tight separating joints which run in a rectilinear fashion. Indeed, with the known embodiments of folding boats, it is possible, with the help of longitudinal and transverse folds, to reduce the size of the boat to a minimal packing size, for transport, for example, but the lateral edges of the individual components of the boat wall, which are connected to one another, and which run in a rectilinear fashion, do not permit a conformation of hull that reacts favorably to currents, or one that is stable, especially for use on the water. Both of the aforementioned American publications teach of folding boats, whose stern and bow areas are formed, in each case, of rectilinear, quadratic plates. An embodiment that is more favorable in currents is shown in the French publication, which teaches of a folding boat whose stern and bow sections are constituted of trapezoidal planar sections of hull that lie adjacent to one another, thus yielding, at least in these sections, an approximately round-shaped hull. In this regard, see especially FIGS. 1 through 8 of FR 22 88 026.

For improved use on the water, French patent 26 11 645, French patent 11 48 062, the German published patent application 33 12 730 A1, U.S. Pat. No. 3,032,784, and German utility patent 17 06 581 teach of boats of a similar type, which have a hull form with rounded lines along its edges. Indeed, the properties for operation on the water, insofar as the technological aspects of currents are concerned, are markedly improved over the aforementioned groups of folding boats, but the latter examples of embodiments do not exhibit the possibility of folding the folded boat's hull in the transverse direction so that in their collapsed state, the boats must be transported in their entire length. The folding boat shown in the German utility patent 17 06 581, exhibits, however, the possibility of at least one line of demarcation running transversely to the longitudinal axis of the boat, with the help of which it is possible, for example, to divide the length of the boat. Accordingly, along this line of demarcation, no provision is made for the individual portions of the boat to fold into one another; rather, provision is made for a mere separation of the individual halves of the boat.

SUMMARY OF THE INVENTION

It is the underlying task of the invention to create a collapsible boat having a body consisting of a myriad of hull surfaces and with at least two hull surfaces, the lateral edges of which lie loose opposite each other in the collapsed state, such that the shape of the hull corresponds substantially to the shape of a boat's hull, which has properties that react favorably in currents. Furthermore, the connective elements between the individual hull elements should permit folds in the longitudinal and transverse direction of the boat. In addition, the stability of the connection between two surfaces of the hull to be connected should be enhanced in such a way that the entire hull per se is resistant to torsion. The individual component surfaces of the hull should be connected, in their disassembled state, by means of at least one of their lateral edges, with the remainder of the parts of the hull surface, so that the collapsing of all hull surface parts is possible in a packing format that is as small as possible.

According to the invention, a collapsible boat according to the invention is indicated in such a way that a connective element connects the loose, opposing lateral edges with the aid of a clamping mechanism that may be disengaged, in such a way as to be water-tight. Furthermore, the lateral edges of the hull surfaces are equipped with a profile, so that the hull surfaces may pivot around a common axis such that they may be transferred into a relative position in which the hull surfaces may be pressed together against one another so as to be water-tight and longitudinally stable.

The ideal underlying the invention is that on the one hand, the surfaces of the hull that constitute the boat's bow area exhibit bent lateral edges which, with the aid of a connective element according to the invention, may be connected with each other in such a way that, on the one hand, they retain their bent side-edge line form, and, on the other hand, they undergo a water-tight, longitudinally stable connection.

The connective element consists of a single or multiple piece acceptance strut, which extends across the entire lateral edge area of the lateral edges of the hull surfaces that may be placed against each other, which constitute the bow area. The connecting element according to the invention, with only the aid of a clamping mechanism that may be loosened, holds the two hull surfaces that are to be joined to one another, which consist, preferably, of a stable material, such as aluminum, for example.

Basically, two preferable embodiments may be realized in this regard:

An initial embodiment pertains to a one-piece acceptance strut for the connection of the lateral edges of two hull surfaces.

The one-piece acceptance strut exhibits a slightly angular cross-section, which makes provision for a corresponding recess for the acceptance of the hull surfaces in the case of both hull surfaces. Since the acceptance strut must follow the line of curve of the lateral edges, it must be configured in such a way as to be as elastic as possible; preferably, it consists of an elastic material, for example, plastic.

In order to fix the two hull areas, which are introduced into the acceptance strut, the two lateral edges, which are to be connected to each other, are each equipped with a fastening aid, which is connected to the surface of the hull in a connection that may not be broken, and is configured in a semi-circular way toward one side of the hull surfaces. For the mutual fixation of the two hull surfaces, a holding apparatus grips into the interior of the semi-circular configuration, so that the lateral edges, with fastening aids, are pressed to the middle connective element which protrudes between them.

The holding device is configured in such a way that, on the one hand, it may be easily applied, and on the other hand, it may be just as readily loosened. This is achieved by virtue of the fact that the holding apparatus, which is U-shaped in its cross-section, which consists of two parts, is secured on the opposite side with a bolt, around which the holding apparatus may be folded into an open and closed position.

A second embodiment relates to a bipartite acceptance strut for the connection of the lateral edges of two hull surfaces.

The bipartite acceptance strut exhibits a lower strut portion which is applied to the underside of the hull surface, into which a spring steel profiled element is wrought along the strut portion, which has protrusions, some in the form of pins, others in the form of bands, which extend into the interior of the boat. The lateral edges of both hull surfaces that are to be joined lie on the surface of the lower portion of the strut, and they are, especially, equipped with indentations through which the ridge-like protrusions of the spring steel profile element jut. Between the lateral edges of the hull areas that are to be joined, which abut one another, there juts, into the interior of the boat, a middle protrusion, which is also configured in a pin-like way, and which is also equipped with threading.

An upper strut portion, which may be applied from the interior of the boat onto the pin-like or band-like protrusions of the spring steel profile element is, in addition, surrounded, by a pressure-resistant covering element that is adapted to the upper portion of the strut so as to be interlocking, onto which, guided by the screw threading of the middle protrusion, a nut may be applied, which produces the requisite pressure to press the two opposing accepting strut portions against one another, so that the hull areas that are to be connected may be connected so as to be longitudinally stable and impervious to water.

With the aid of these connective elements according to the invention, it is possible, for the first time, to join hull portions of a collapsible boat with curved lateral edges in each case in such a way that they may be joined to one another in a manner that is longitudinally stable and impervious to water.

The thought behind the invention, however, also entails the possibility, with the aid of a connective mechanism according to the invention, of connecting the remaining hull surface areas in such a way that they meet the requirements of a collapsible boat, that is to say, effecting a considerable reduction in the size of the boat in its collapsed state.

Basically, the collapsible boat according to the invention exhibits, in addition to the already-described bow connection joints, three additional separation joints of varying types. Thus it requires, depending upon the angle that is described by each of two adjacent hull surface components, different connecting apparatuses in each case. Thus, a distinction is drawn, in this context, between the connective elements already described for the purpose of connecting the hull surfaces in the area of the bow, and connective elements for longitudinal folding.

The latter connective elements for longitudinal and transverse folding, distinguish themselves, according to the invention, by virtue of the fact that the lateral edges of the hull areas are provided with a profile so that the hull areas may be rotated around a common axis and transferred into a relative position in which the hull areas may be pressed against one another so as to be water-tight and longitudinally stable.

In an advantageous way, so-called profile elements are applied to the hull areas in such a way that they may not be loosened, the commonly shared feature of which elements is an extension, eye-shaped in cross-section, which is provided alternatively on both sides that are to be connected. Due to the alternating arrangement of the eye-shaped extensions on the sides in each instance, it is thus possible to join both lateral edges in such a way that a channel that passes through is formed, which channel is composed of the individual eye-shaped extensions. A long splint or a correspondingly shaped wire, around which both lateral edges may be moved, may be passed through this channel.

The profile element that is set upon the lateral edges is configured in such a way that in the state in which the two edges are pressed together, they exhibit zones that immediately abut one another. Similarly, provision is made for zones that, with one another, enclose a hollow space, into which, preferably, sealing material, such as PU [polyurethane] foam or silicone mass may be introduced.

Furthermore, the areas in which both profile elements touch exhibit constituent zones in which a conical configuration fits into a correspondingly-shaped recess on the opposite profile. This provision relieves the stress upon the eye-shaped extensions by mechanical means, which must withstand the transverse forces.

Thus, the profile elements configured in this way assume the following three functions: a connective function between two adjacent hull surfaces, the function of imparting rigidity on the basis of the correspondingly profiled configuration of the profile elements, and a sealing function, for example, by taking advantage of suitable sealing materials, such as round silicone string.

BRIEF DESCRIPTION OF THE DRAWINGS

The invention is described below in exemplary fashion, without imposing any restriction on the thought underlying the invention, by virtue of the examples of embodiments, by referring to the drawing, to which express reference is made insofar as revelation of all details for which explanations are not given in the text is concerned.

DESCRIPTION OF PREFERRED EMBODIMENTS

Figure 1:
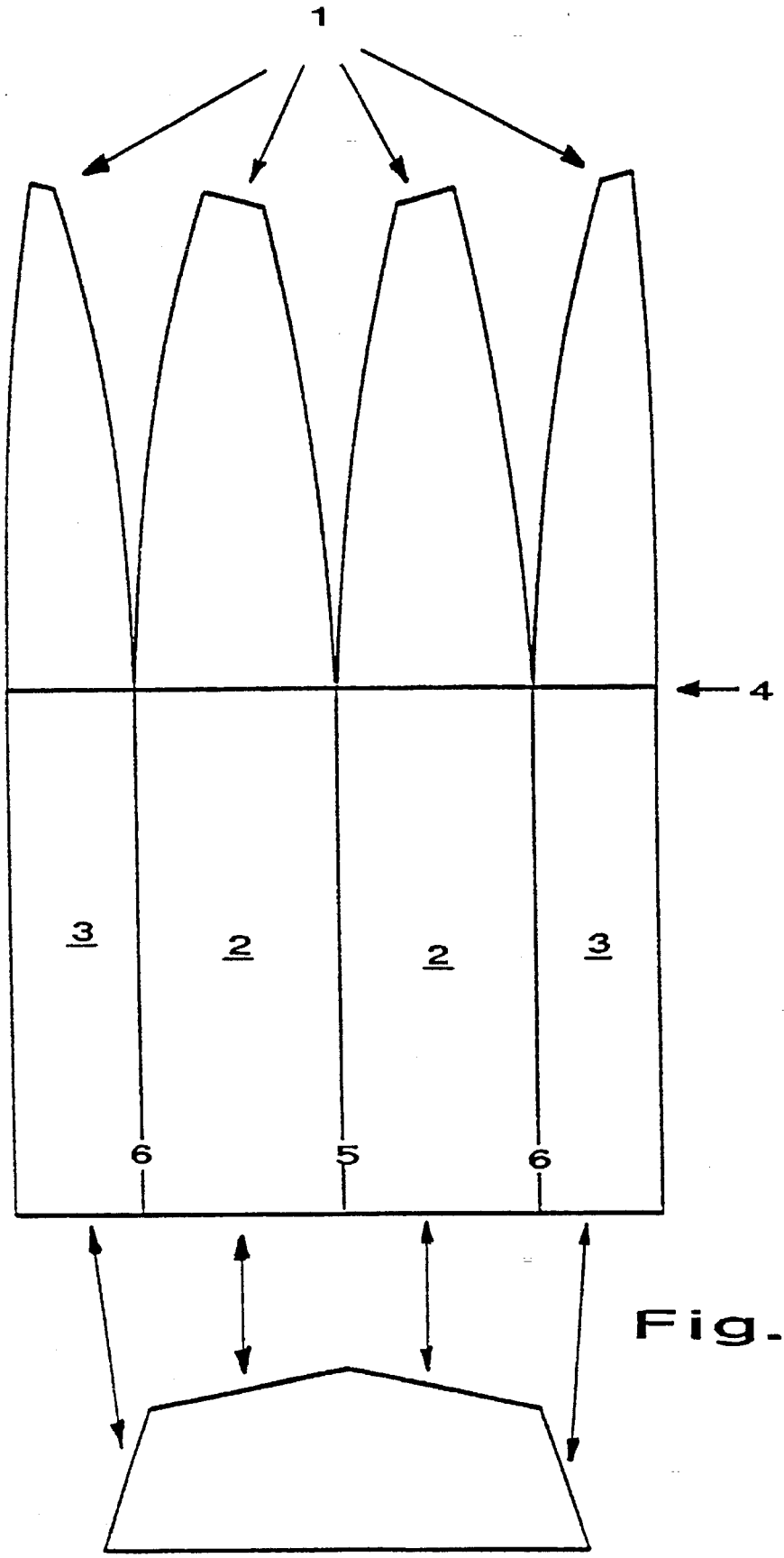
FIG. 1 shows a representation of the individual hull surface components to be joined.

In the representation above, FIG. 1 shows a top view of the hull sections to be joined, in a dismantled state. Once they have been joined, the hull sections 1 form the bow area of the boat, and they exhibit round side edges. It is thus assured that the shape of the hull, in the area of the bow, is configured in a way that is favorable to flow. The portions of the hull, 1, are, with the exception of their lower, rectilinear lateral edge, joined, in each case with the deck hull plates 2, or the lateral hull plates, 3, without further contact with other hull surfaces.

The folding of the boat is initially possible around the lateral axis, 4. In this way, the embodiment example shown in FIG. 1 is reduced in its length by half. Furthermore, the lateral hull areas, 3, may be folded around the bending lines, 6, and finally, folding line 5 permits a further reduction of the size of the folded boat. The lower representation shown in FIG. 1 shows a cross-section through the assembled boat. The corresponding arrows clarify the position of the individual deck hull or side hull surfaces, 3, in the boat in its assembled state.

Figure 2C:
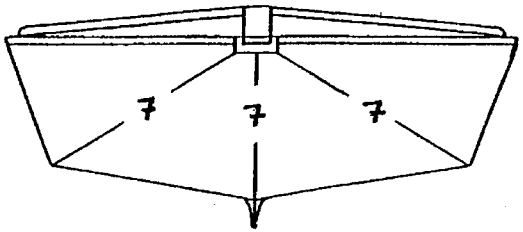
FIGS. 2*a, b, c* show three lateral views of an advantageous embodiment of a collapsible folding boat.
Figure 2B:
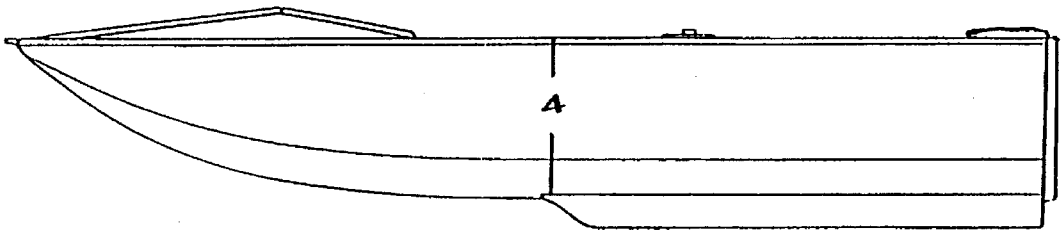
Figure 2A:
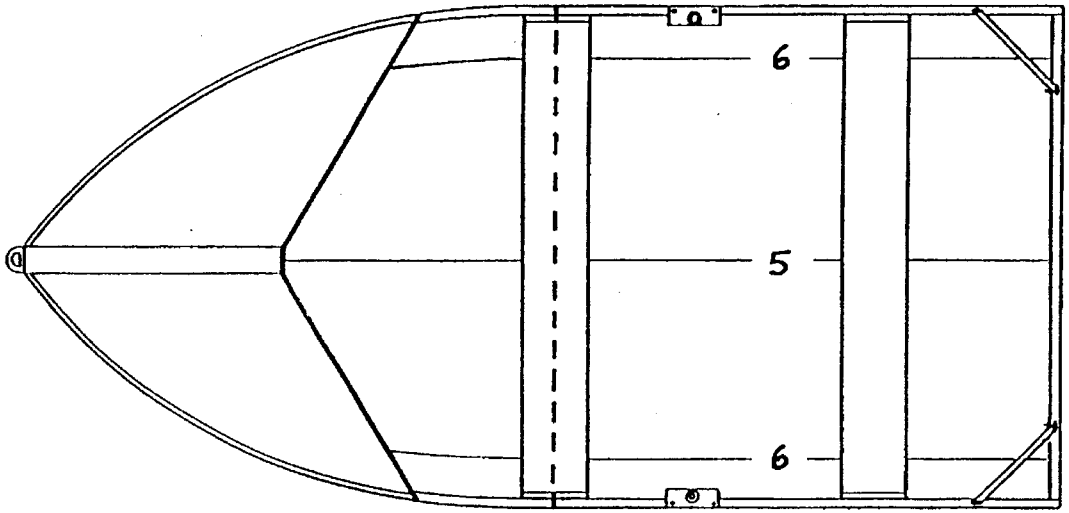

FIG. 2*a* shows a top view of an assembled boat, showing folding lines 5 and 6. FIG. 2*b* shows a side view of the assembled boat that exhibits, in its midst, transverse fold line 4, so that the boat, in its length, is reduced by half in its collapsed state.

FIG. 2*c* shows the boat in frontal view. The bow area is constituted by bow hull surfaces 1, which may be connected with each other along bow demarcation line 7.

Figure 3A:
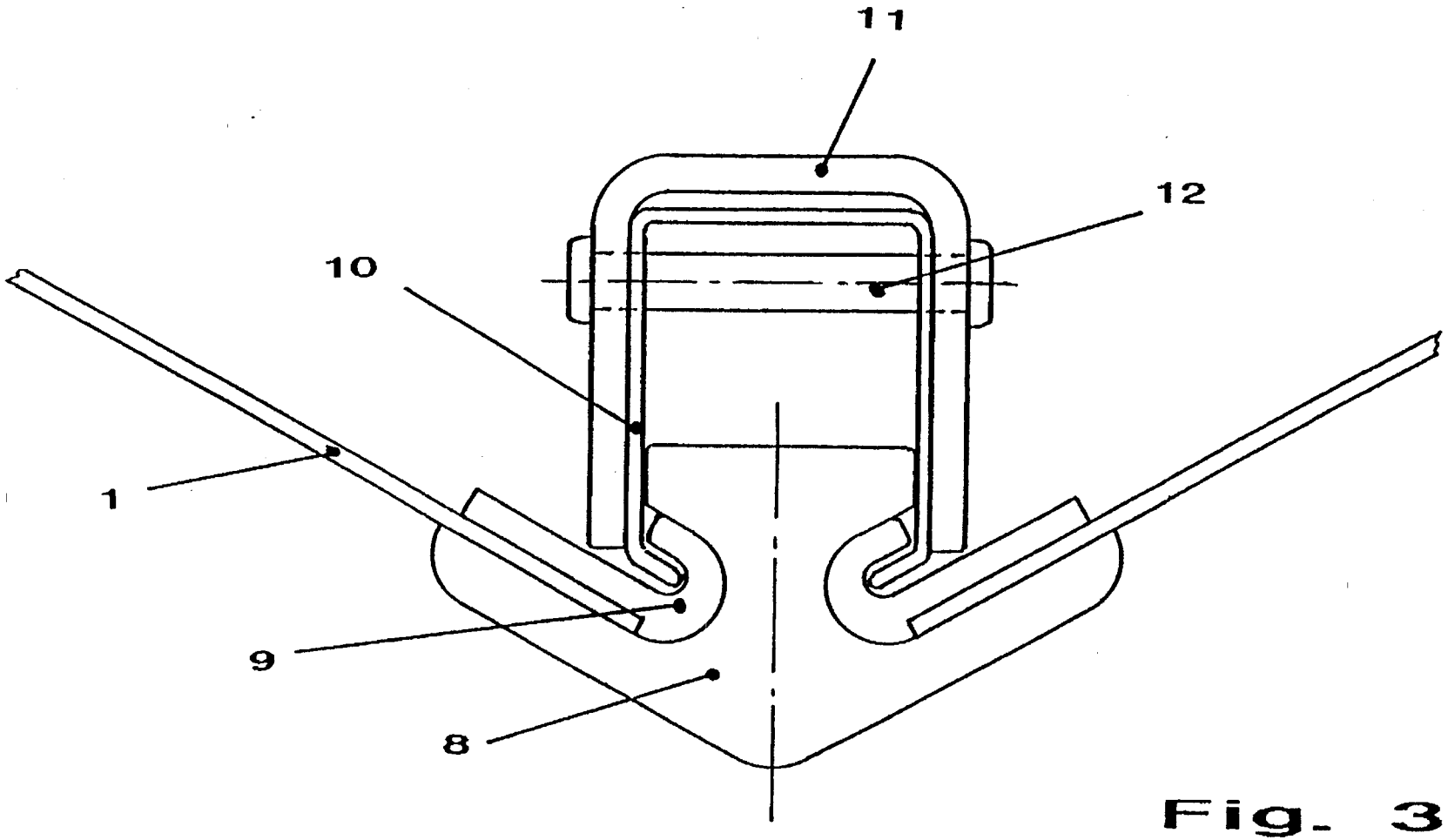
FIGS. 3*a, b, c* show cross-section views of a one-piece acceptance strut as well as a representation of the functional principle of the holding apparatus.

In order to join the bow hull areas 1, an elastic, one-piece acceptance strut is provided, which is shown in FIG. 3*a* in a cross-section view. Acceptance strut 8 exhibits a V-shaped configuration, and provides for the acceptance of the lateral edges of recesses corresponding to bow hull areas, 1. In the area of the edge of bow hull area 1, a so-called attachment aid, 9, which is semi-circular in its configuration at one end, is attached in such a way that it cannot be released. A holding device consisting of two pieces, fixing bracket 10, and force bracket 11, which surrounds fixing bracket 10, engages the interior of this semi-circle. The fixing bracket, 10, is configured out of spring steel, and is equipped with a forward-arching bend in such a way that the two open ends of the fixing bracket, 10, without the force bracket which surrounds it, stand away from one another (see also FIG. 3*b*). In this way, fixing bracket 10, by virtue of force bracket 11, is pressed onto the semi-circular interior side of anchoring element 9. A security bolt, 12, assures the fixing of both brackets, 10 and 11, from the opposite side.

Figure 3C:
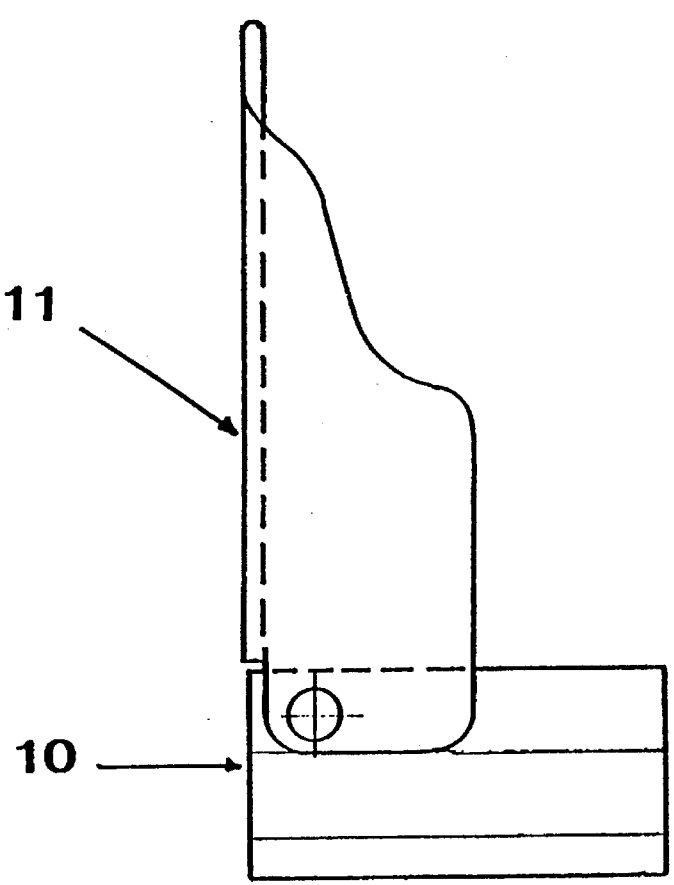
Figure 3B:
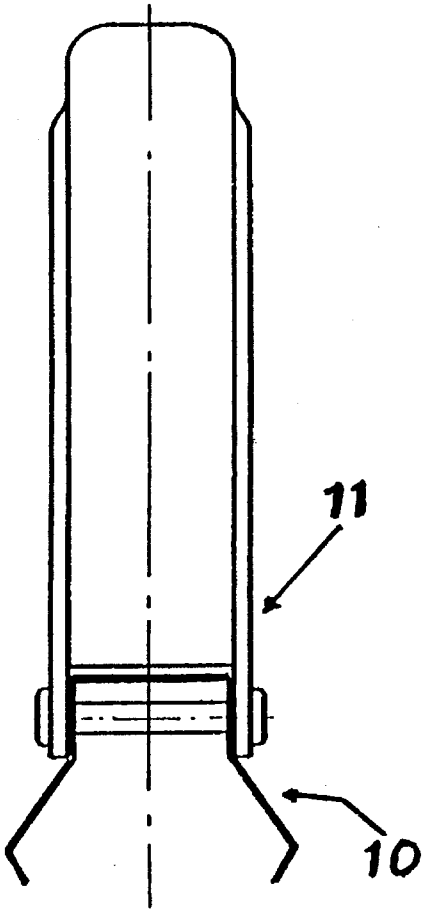

With the aid of a connective element, it is possible to connect two rigid hull areas with one another in a simple manner, without having to resort to involved connection measures. Thus, the two lateral edges of the bow hull areas are to be laid into the recesses of the acceptance strut. Then, fixing bracket 10, which is spread apart in any case, is led around the middle ridge of acceptance strut 8. Only when the holding bracket, 11, is placed across fixing bracket 10, do the lower ends of fixing bracket 10 engage the attachment devices, 9, of the bow hull areas and press the latter against acceptance strut 8. FIGS. 3*b* and 3*c* exhibit an advantageous embodiment of force bracket 11, which is constituted as a rapid stretching mechanism. Thus, force bracket 11, in its open position, as depicted in FIGS. 3*b* and 3*c*, quickly releases fixing bracket 10, so that the acceptance strut is freed of stress. Folding back the force bracket leads to the condition as depicted in FIG. 3*a*.

It is just as easy to effect a breakdown of the boat by performing the steps described above, in reverse order.

Figure 4A:
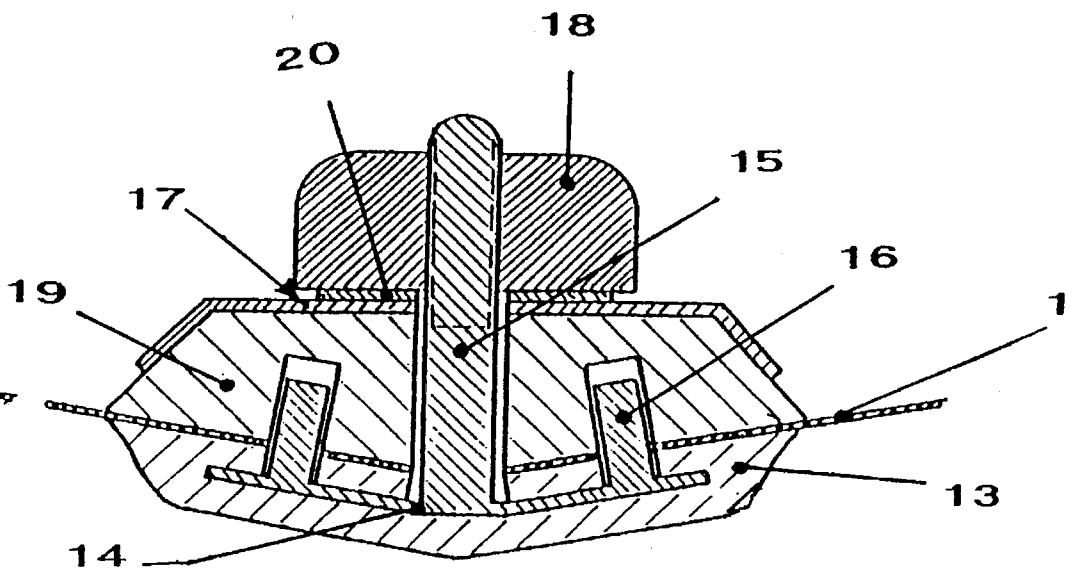
FIGS. 4*a, b* show a cross-section view of the two-piece acceptance strut.
Figure 4B:
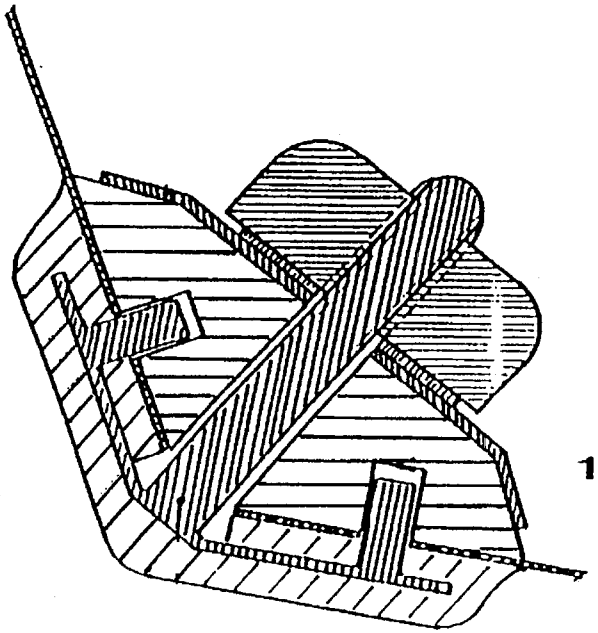

By contrast with the one-piece acceptance strut 8, FIGS 4*a* and 4*b* show a two-piece form of the acceptance strut. The acceptance strut exhibits, substantially, a lower portion, 13, and an upper portion, 19, which, like the one-piece acceptance strut, are manufactured out of an elastic material, such as plastic, for example. In the lower portion of the strut, 13, a spring steel profile element, 14, is wrought in, which exhibits, in the direction of the boat's interior, pin-like, or band-like protrusions, 16 and 15, which protrude through suitable recesses in hull 1, into or through strut portion 19. Due to the protrusions, 16, which are arranged symmetrically to the central protrusion, 15 of the spring steel profile element (in FIG. 4*a*, reference number 16 also applies to the left protrusion), which, in each case, protrude through hull area plate 1, the hull plates, 1, are prevented from gliding laterally out of the acceptance strut.

From the interior of the boat, an upper strut portion, 19, is assigned to the lower strut portion, 13, which exhibits holes that correspond to the pin-shaped or band-shaped protrusions, 15 and 16, so that the upper strut portion, 19, lies seamlessly against the opposite side of the hull area portions relative to the lower strut portion, 13. By way of the upper strut portion, 19, a correspondingly seamlessly adjusted pressure-resistant covering element is applied through which, in its midst, the upper portion of the protrusion juts. This protrusion exhibits a threaded portion, onto which an attachment nut, 18, may be applied, which exerts, via washer 20, such high compressive power on the sandwich-like structure, that, on the one hand, a water-tight fastening, and or the other hand, a stable fastening of both hull surfaces, 1, is assured.

FIG. 4*a* shows an advantageous embodiment of a two-piece acceptance strut for the connection of both centrally arranged bow hull area parts, whereas, by contrast, FIG. 4*b* shows a connective element having basically an identical structure that connects, in each case, a bow hull lateral section with a bow hull mid-section. The only difference is reflected in the different V-shape of the arrangement.

Figure 5A:
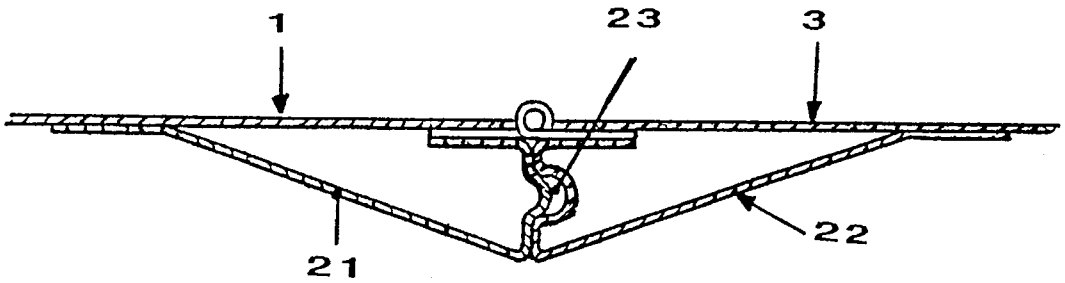
FIGS. 5*a, b* show a lateral representation and a representation in perspective of a lateral hinge.
Figure 5B:
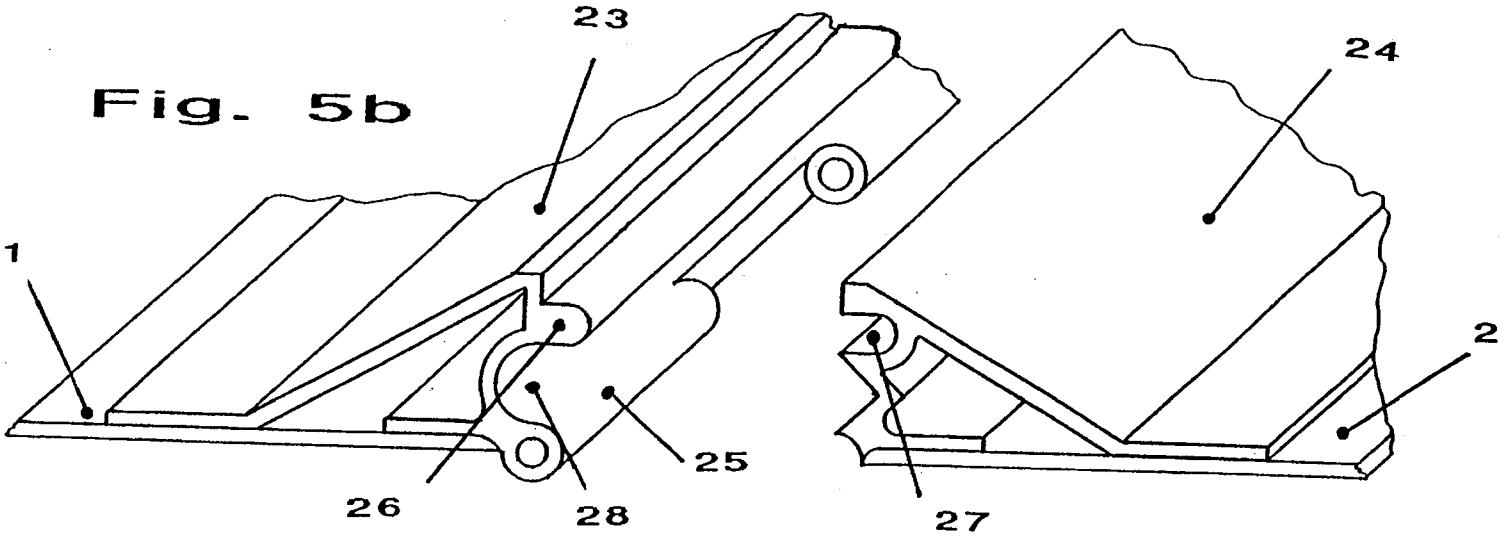

The embodiments shown in FIGS. 5*a* and 5*b*, which refer to a connective element between hull area portions, pertain to the transverse connection of the individual portions of the hull area along demarcation line 4, which may be derived, for example, from FIGS. 2*b*, or 1, top view. FIG. 5*a* shows the connection between a bow hull area 1, and, for example, a lateral hull section, 3. On both hull areas, which lie opposite one another, profile elements, 21 and 22 are arranged so as to be firmly linked with each other, both of which are connected to one another by way of a common, commercially-available hinge.

If the movable hinge is opened so that the profile elements, 21 and 22, which oppose one another, lie in such a way that they fit each other most exactly, the typical conformation shown in FIG. 5*a* provides, on the one hand, an effective water-occlusive seal, and on the other hand, a stable connection between both hull surface areas 1 and 3. The profiling of the individual profile elements is selected in such a way that in the state shown, they encompass a hollow space, 23, in which, preferably, sealing material may be placed.

The force with which the hinge presses both profile elements against each other, is caused by a seat board introduced into the hull of the boat in such a way that it lies transverse to the boat's longitudinal axis, as is shown, for example, by FIG. 2*a* (in this regard, see the seat board, through which a broken line passes).

An improved embodiment for the purpose of connecting the portions of the hull area in the transverse direction may be seen from FIG. 5*b*, in perspective view. Here, too, at hull area portions 1 and 2, corresponding profile elements, 22 and 23, are arranged so as to be firmly bonded. The connection may result from a weld, for example, or a riveted connection. Characteristic of the profile element according to the invention is an apparatus by which both initially loose hull surface areas may be joined in such a way that they are mobile around a commonly-shared axis. Thus, on the left profile element, an eye-shaped extension, 25, is visible, which exhibits, in the axial direction, in each case, interruptions of the extension. At these points of interruption of the extension on the opposing profile element, 24, a corresponding eye-shaped extension (not visible in FIG. 5*b*) is provided so that after both hull area portions are brought together, the eye-shaped extension, 25, constitutes a complete cylindrical hollow channel, through which a correspondingly configured splint or a wire of similar configuration may be passed. In addition, the embodiment that is shown exhibits a protrusion, 26, on the left profile element, which juts into a corresponding recess, 27, of the right profile element so as to constitute a perfect fit. Once both hull area portions are joined, the profiling per 26 and 27 affords a further enhancement of stabilization, while at the same time relieving the hinge-like connective apparatus, 25, of the transverse forces that occur. In this embodiment, as well, provision is made for an interior space, 28, which results from the joining of both profile elements, into which a corresponding sealing material can be introduced.

Figure 6A:
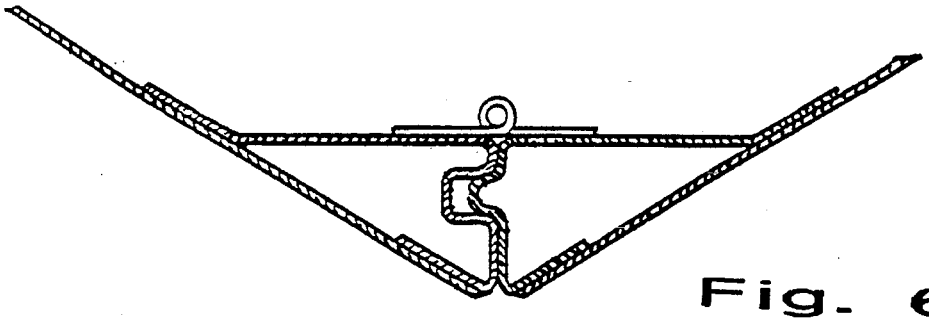
FIGS. 6*a, b, c* show a cross-section representation of various embodiments of a lateral hinge, and FIGS. 7*a, b* show a cross-section view and perspective representation of a keel hinge.
Figure 6B:
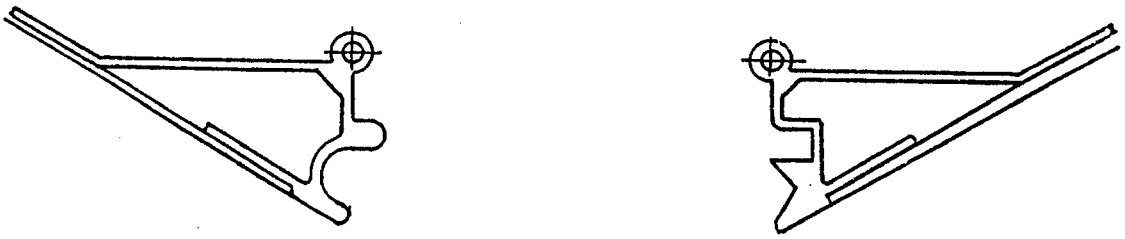
Figure 6C:
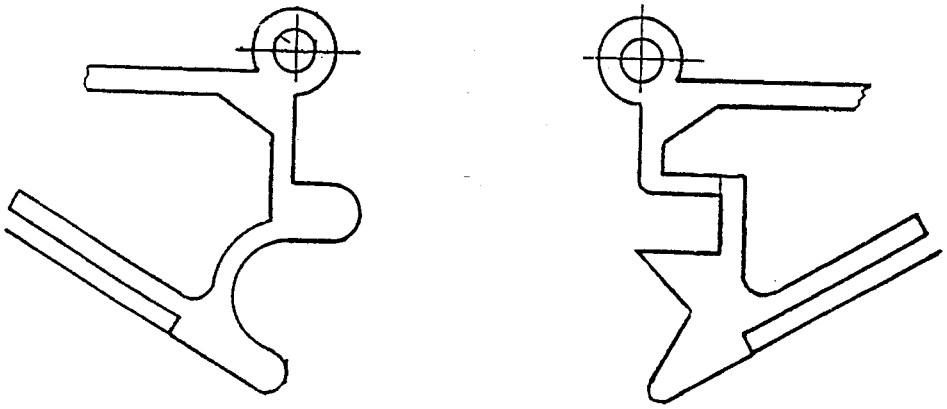

In FIGS. 6*a* through 6*c*, connective elements for the joining of the areas of the hull deck area with the portions of the hull lateral areas are indicated. At this juncture, attention is called to FIG. 2*a* and FIG. 1, top view, from which the connective line 6 becomes apparent, for which the connective elements according to FIGS. 6*a* through 6*c* are provided. In the main, the embodiments depicted in these figures do not differ from those in FIG. 5*a* and FIG. 5*b*, but they do show the universality of the connective principle in relation to the sizes of the angles at which individual portions of hull areas abut against each other. Without regard for the enclosed angle of two hull area portions, the aforementioned profile element can be adjusted to the corresponding conditions.

Figure 7A:
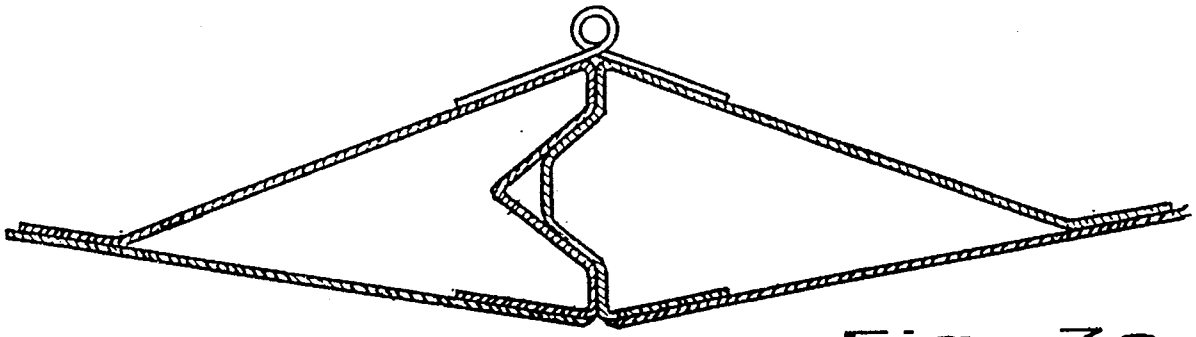
Figure 7B:
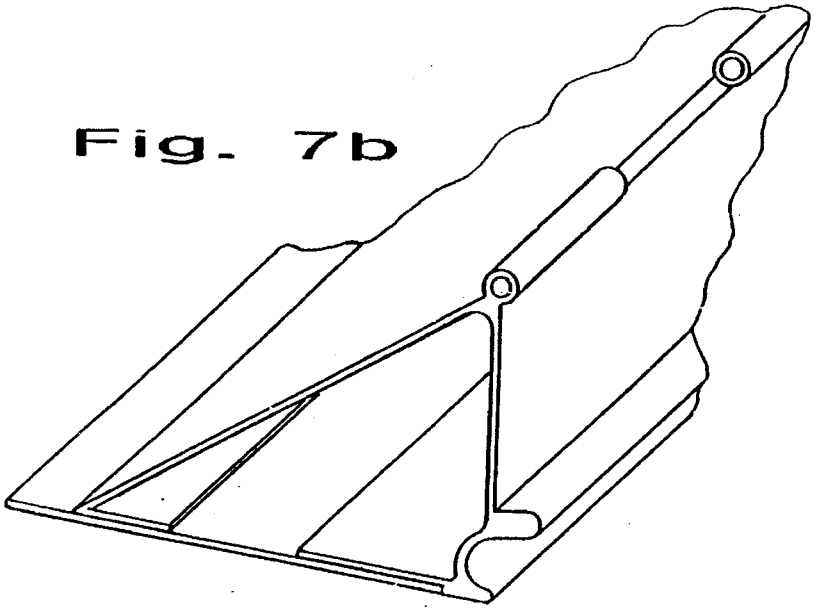

The same situation applies with the profile elements according to FIG. 7*a* and FIG. 7*b*, which connect two deck hull surface areas with each other. At issue here is the connection according to demarcation line 5, which is also represented in FIG. 1 or FIG. 2*a*.

With the connective devices according to the invention, therefore, it is possible for the first time to indicate a folding boat that may be assembled that exhibits round contour edges in the area of the bow, and, simultaneously, a hull that follows a straight line. With the aid of these connective devices, it is possible, on the one hand, to configure a craft that reacts favorably to currents in its below-water configuration, which has, on the other hand, high stability, in particular, longitudinal stability.

I claim:

1. A collapsible boat having a boat body comprising:

a plurality of hull surfaces wherein at least two of the lateral edges of said hull surfaces in the disassembled state, lie loose opposite each other, a connecting element with a disengageable clamping mechanism that connects said loose opposite lateral edges together so as to be watertight and an acceptance strut which possesses notches for the acceptance of said lateral edges of said hull surfaces.

2. The collapsible boat according to claim 1 wherein said acceptance strut consists of elastic or plastic material.

3. The collapsible boat according to claim 1 wherein said acceptance strut is bi-partite and comprises an initial strut portion that is arranged on the side of the hull surface areas that faces the water, and a second strut portion that lies opposite the first, on the interior side of the hull.

4. The collapsible boat according to claim 3 wherein said initial strut portion includes a spring steel profile element that exhibits pin-shaped first protrusions that are oriented so as to be perpendicular to the interior of the boat and a second protrusion in the middle of the opposing hull surfaces in such a way with reference to the hull surfaces that lie opposite each other juts through said second strut portion and a pressure-resistant deck element so adjusted as to be form-fitting into the interior of the boat.

5. The collapsible boat according to claim 4 wherein said second protrusion comprises threading.

6. The collapsible boat according to claim 5 wherein a removable nut is threaded onto said second protrusion and said nut presses the sandwich-like structure, consisting of a deck surface and two strut portions, together so firmly that the hull area connection is stable and watertight.

7. The collapsible boat according to claim 1 wherein said acceptance strut consists of one piece and provides interlocking recesses for the acceptance of said lateral edges of said hull surfaces that are to be joined to each other.

8. The collapsible boat according to claim 7 characterized by the fact that in the area of said lateral edges of the hull surface that are to be joined, a securing aid is provided that is permanently connected with the hull surface and is configured toward one side of the hull surface so as to be semi-circular.

9. The collapsible boat according to claim 8 wherein said fastening aid is arranged in said acceptance strut in such a way that said semi-circular configuration juts into the interior of said boat.

10. The collapsible boat according to claim 9 wherein holding apparatus fixes said hull surfaces that are introduced into said acceptance strut on the inside of said boat.

11. The collapsible boat according to claim 10 wherein said holding apparatus comprises a pair of U-shaped parts, an initial fixing bracket which engages with said fastening aids and a force bracket which lies next to and around said fixing bracket.

12. A collapsible boat having a boat body comprising:

a plurality of hull surfaces wherein, at least two of the lateral edges of said hull surfaces in the disassembled state, lie loose opposite each other, said lateral edges of said hull surfaces having a profile so as to be transferrable into a relative position in which said hull surfaces may be pressed against each other so as to be water-tight and longitudinally stable, said profile of said lateral edges having an extension, eye-shaped in cross-section, through which, after corresponding juncture of two said lateral edges, a longitudinal unit may be removably introduced.

13. A collapsible boat according to claim 12 wherein said longitudinal unit is a long splint or wire.

14. A collapsible boat according to claim 12 wherein said lateral edges comprise a hinge.

15. A collapsible boat according to claim 12 wherein said profile of said lateral edges comprise areas in which said profiles when pressed against each other, touch, so as to form a water-tight seal and beyond that have areas that render the introduction of additional sealing material possible.

16. A collapsible boat according to claim 12 wherein said profile of one of two lateral edges that lie opposite each other exhibits a section that juts out substantially perpendicularly from said lateral edge and fits into a corresponding recess in the profile of the other of said lateral edges.

* * * * *